US008601944B2

(12) United States Patent
Pei

(10) Patent No.: US 8,601,944 B2
(45) Date of Patent: Dec. 10, 2013

(54) SCREEN PRINTING MACHINE

(75) Inventor: Shao-Kai Pei, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 39 days.

(21) Appl. No.: 13/485,933

(22) Filed: Jun. 1, 2012

(65) Prior Publication Data

US 2013/0247786 A1 Sep. 26, 2013

(30) Foreign Application Priority Data

Mar. 22, 2012 (TW) ..... 101109839 A

(51) Int. Cl.
*B41L 13/18* (2006.01)
*B41F 15/00* (2006.01)

(52) U.S. Cl.
USPC ..... 101/123; 101/114; 101/115; 101/124; 101/126

(58) Field of Classification Search
USPC ..... 101/41, 114, 115, 123, 124, 126, 101/128.21, 128.4, 129; 118/218, 301
IPC ..... B41F 15/12,15/14, 15/18, 15/40, 15/42, B41F 15/44, 15/47; B41L 13/02, 13/18
See application file for complete search history.

(56) References Cited

U.S. PATENT DOCUMENTS

| | | | | |
|---|---|---|---|---|
| 5,619,919 | A * | 4/1997 | Karlyn et al. | 101/123 |
| 6,101,937 | A * | 8/2000 | Murakami | 101/123 |
| 6,494,133 | B2 * | 12/2002 | Ooe | 101/123 |
| 7,096,781 | B2 * | 8/2006 | Katano et al. | 101/123 |
| 8,371,217 | B2 * | 2/2013 | Edmonds | 101/123 |

* cited by examiner

*Primary Examiner* — Judy Nguyen
*Assistant Examiner* — Marissa Ferguson Samreth
(74) *Attorney, Agent, or Firm* — Altis Law Group, Inc.

(57) ABSTRACT

A screen printing machine includes a supporting member, a printing mechanism, and a spraying mechanism. The supporting member includes a supporting surface, a number of cavities defined in the supporting surface to receive a number of substrates, and a number of screens detachably covering the plurality of cavities. The printing mechanism includes a guide plate located above the screens, a sliding device slidably connected to the guide plate, a roller rotatably connected to the sliding device, and a squeegee. The sliding device is configured to drive the roller to roll across and the squeegee to slide across the screens. The spraying mechanism is located at one side of the supporting member for dispensing printing material onto the press roller.

10 Claims, 3 Drawing Sheets

SCREEN PRINTING MACHINE

BACKGROUND

1. Technical Field

The present disclosure relates to a screen printing machine for printing images on a number of substrates.

2. Description of Related Art

Screen printing is a method of printing images on substrates using a screen with a number of mesh openings. Some mesh openings of the screen are filled with impermeable substance, and the remaining mesh openings form a stenciled pattern. The ink is forced through the empty mesh openings by a squeegee, thereby forming an image corresponding to the stenciled pattern onto the substrate. Although conventional screen printing machines satisfy basic requirements, a new type of screen printing machine is still needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure are described with reference to the accompanying drawings.

Figure 1:
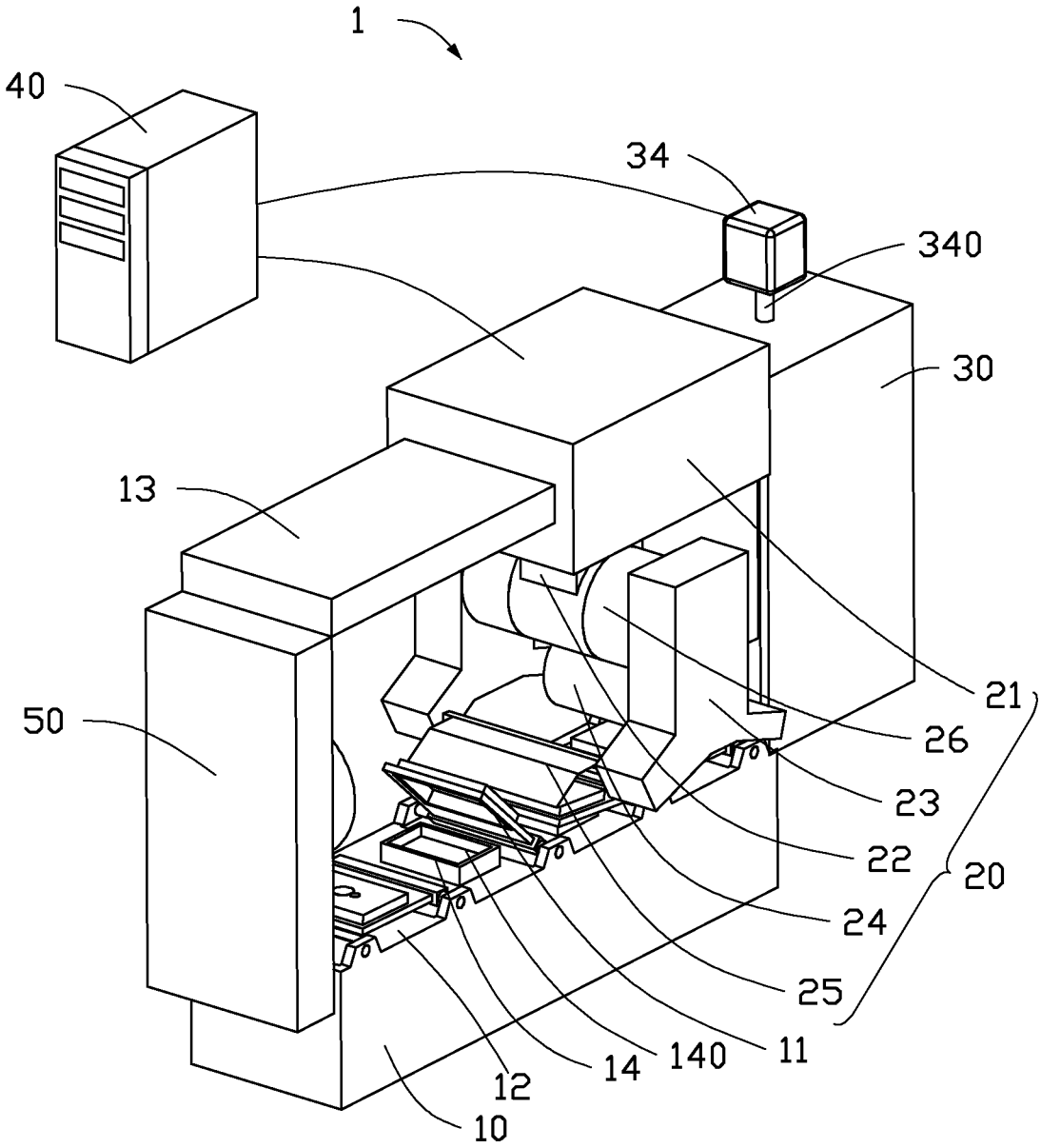
FIG. 1 is a schematic view of the screen printing machine in accordance with an exemplary embodiment.

Referring to FIG. 1, a screen printing machine 1 according to an exemplary embodiment is illustrated. The screen printing machine 1 includes a supporting member 10, a printing mechanism 20 located above the supporting member 10, a spraying mechanism located at one side of the supporting member 10, and an exposure device 50 located at an opposite side of the supporting member 10.

The supporting member 10 includes a supporting surface 12, a guide plate 13 located above the supporting surface 12, a number of receiving members 14 located on the supporting surface 12, and a number of screens 11. In the embodiment, the screens 11 are positioned in a line, and the guide plate 11 extends parallel to and is located above the screens 13. The receiving members 14 each define a cavity 140 for receiving a substrate (not shown) therein, and the screens 13 are rotatably connected to the supporting surface 12 and can be rotated to a position to cover the cavities 140.

Figure 2:
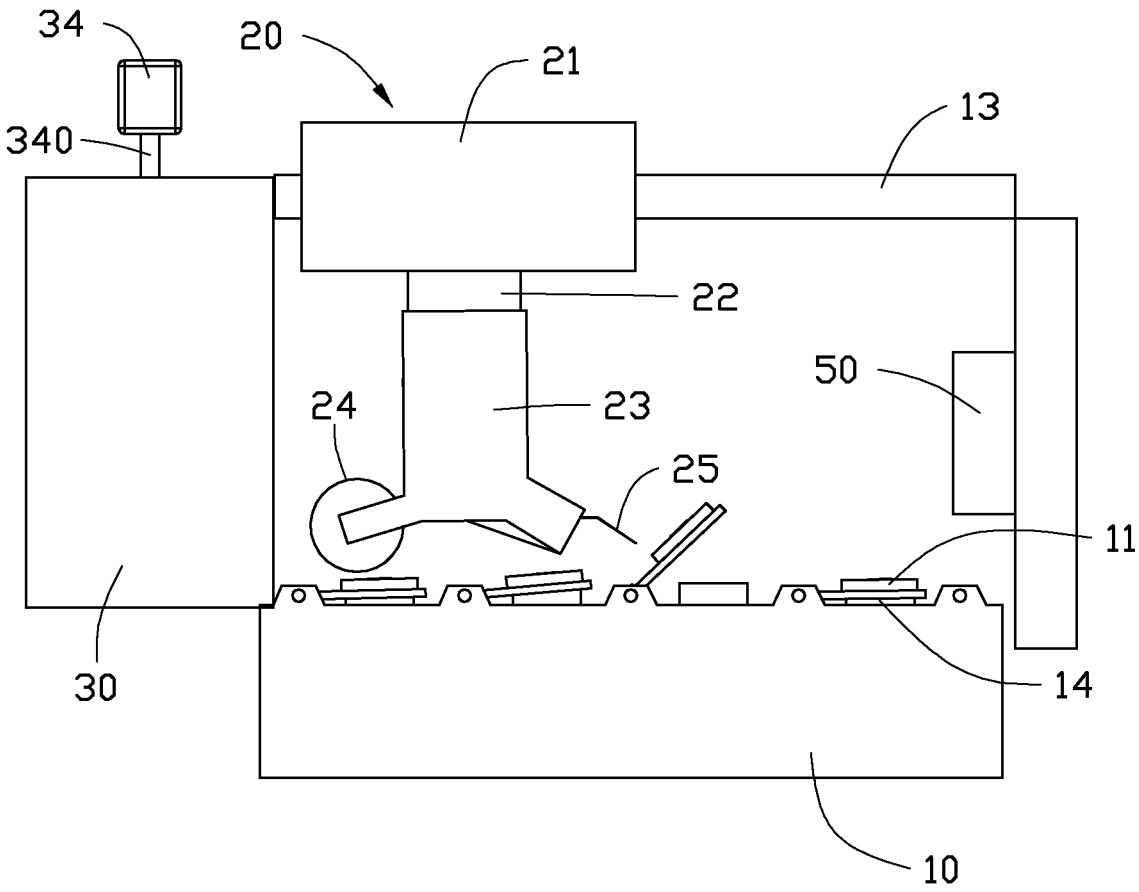
FIG. 2 is a side view of the screen printing machine of FIG. 1.

Referring also to FIG. 2, the spraying mechanism 20 includes a sliding device 21, a transmission rod 22 with one end fixed to the sliding device 21, a shaft 26 rotatably connected to an opposite end of the transmission rod 22, two arms 23, a roller 24 rotatably connected between the two arms 23, and a squeegee 25 fixed between the two arms 23. The sliding device 21 is sleeved on the guide plate 13 and capable of moving along the guide plate 13. The shaft 26 is substantially perpendicular to the transmission rod 22, and the two arms 23 are fixed to two opposite ends of the shaft 26. When the shaft 26 is rotated a fixed amount in one direction with respect to the transmission rod 22, the roller 24 is positioned to move with the arms 23, and roll across the screens 11 on the supporting surface 12. When the shaft 26 is rotated a fixed amount in an opposite direction with respect to the transmission rod 22, the squeegee 25 is positioned to move with the arms 23, and slide across the screens 11 on the supporting surface 12.

Figure 3:
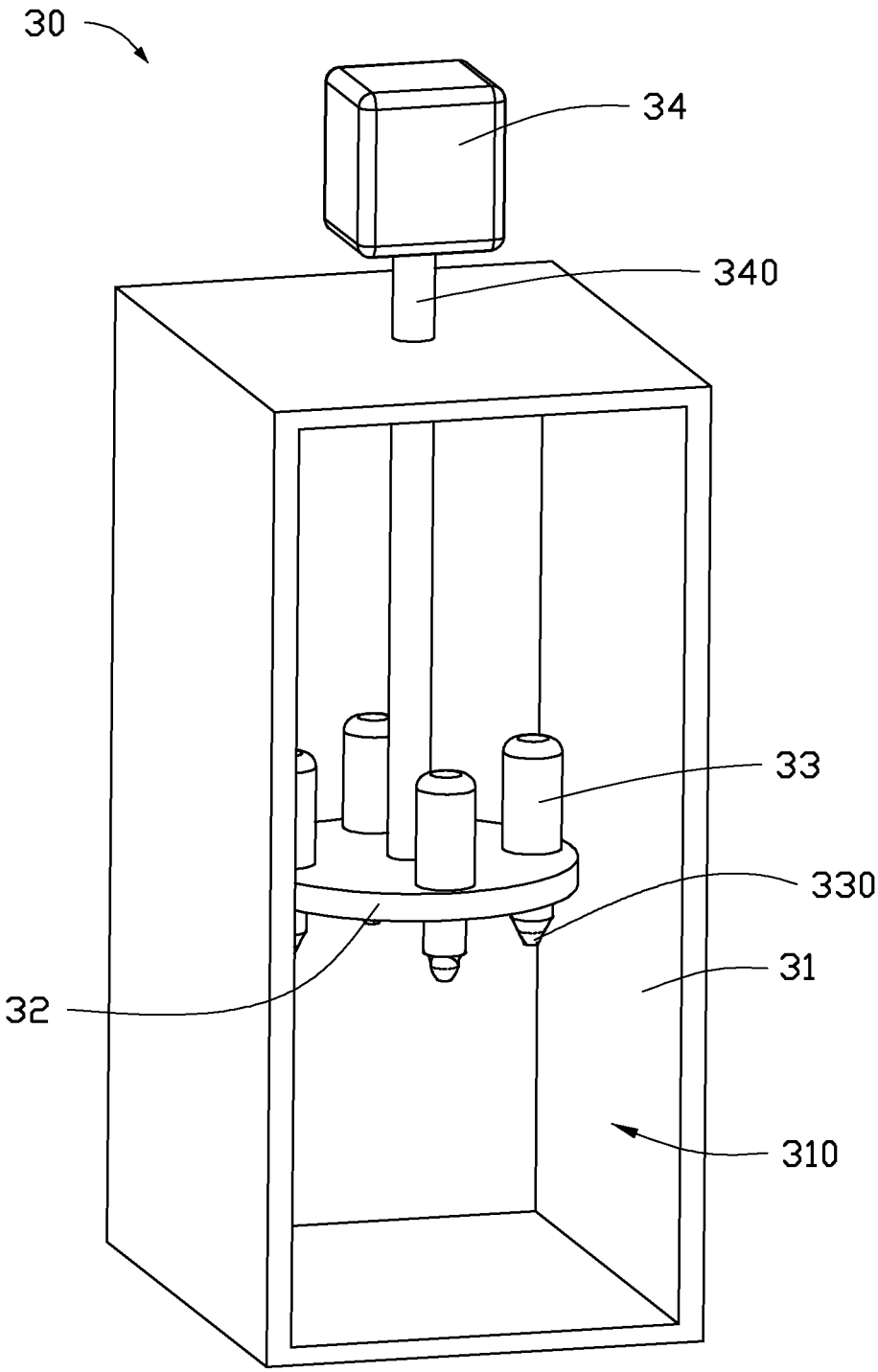
FIG. 3 is an isometric view of a spraying mechanism of the screen printing machine of FIG. 1.

Referring to FIG. 3, the spraying mechanism 30 includes a housing 31 defining a receiving space 310 facing the roller 24, a mounting plate 32 retained within the receiving space 310, a number of containers 33 secured to the mounting plate 32, and a rotating device 34 located above the housing 31. Each container 33 is used to accommodate different printing material, e.g. photosensitive emulsion and different colored inks. The containers 33 each include an outlet 330 below the mounting plate 32 that can be opened to allow the printing material to flow out. When the roller 24 is moved into the housing 31 to abut against the outlet 330, the container 33 can be urged to dispense the printing material onto the roller 24.

The rotating device 34 includes an output shaft 340 connected to the mounting plate 32. In the embodiment, the rotating device 34 is a motor. The mounting plate 32 can rotate when driven by the rotating device 34, thereby allowing one of the containers 33 to move to a proper position to dispense the printing material onto the roller 24. The process of screen printing using the screen printing machine 1 is as follows.

In a first step, the rotating device 34 rotates the mounting plate 32 until one desired container 33 containing the photosensitive emulsion is adjacent to the roller 24, and the sliding device 21 slides toward the spraying device 30 and drives the roller 24 to abut against the outlet 330 of the container 33. The desired container 33 then dispenses the photosensitive emulsion onto the roller 24. Then, the sliding device 21 slides back toward the exposure device 50, allowing the roller 24 to roll on the screens 11 and apply the photosensitive emulsion evenly onto the screens 11. After that, the screens 11 are exposed by the exposure device 50 and dried by a drying device (not shown). Then, a number of empty mesh openings remain in the screens 11 to form stenciled patterns.

The roller 24 may be cleaned by a user or a cleaning machine (not shown) after the first step. In a second step, the rotating device 34 rotates the mounting plate 32 until one desired container 33 containing the ink is moved adjacent to the roller 24, and the sliding device 21 slides toward the spraying device 30 and drives the roller 24 to abut against the outlet 330 of the container 33. The desired container 33 then dispenses the ink onto the roller 24. Then, the sliding device 21 slides back toward the exposure device 50, allowing the roller 24 to roll on the screens 11 and apply the ink evenly onto the screens 11.

In a third step, the substrates are positioned in the cavities 140 of the receiving member 14, and the shaft 26 is rotated by a user to allow the squeegee 25 to push against the screens 11. Then the sliding device 21 slides along the guide plate 13, and the squeegee 25 can thus force the ink onto the substrates, thereby forming images corresponding to the stenciled patterns on the substrates.

In the embodiment, the screen printing machine 1 further includes a controller 40 for controlling the movements of the sliding device 21 and the rotating device 34.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A screen printing machine comprising:

a supporting member comprising a supporting surface, a plurality of cavities defined in the supporting surface to receive a plurality of substrates, and a plurality of screens detachably covering the plurality of cavities;

a printing mechanism comprising a guide plate located above the screens, a sliding device slidably connected to the guide plate, a roller rotatably connected to the sliding device, and a squeegee, wherein the sliding device is configured to drive the roller to roll across and the squeegee to slide across the screens; and a spraying mechanism comprising a housing connected to one side of the supporting member and defining a receiving space facing toward the roller, the spraying mechanism configured for dispensing printing material onto the roller.

2. The screen printing machine as described in claim 1, wherein the supporting member comprises a row of receiving members located on the supporting surface, and the cavities are defined in the receiving members.

3. The screen printing machine as described in claim 1, wherein the screens are rotatably connected to the supporting surface.

4. The screen printing machine as described in claim 1, wherein the screens are positioned in a line, and the guide plate extends parallelly to and is located above the screens.

5. The screen printing machine as described in claim 1, wherein the printing mechanism comprises a transmission rod connected to the sliding device, a shaft rotatably connected to the transmission rod, and two arms connected to opposite ends of the shaft, the roller and the squeegee are arranged between the arms, when the shaft is rotated a fixed amount in one direction with respect to the transmission rod, the roller is positioned to move with the arms, and roll across the screens, and when the shaft is rotated a fixed amount in an opposite direction with respect to the transmission rod, the squeegee is positioned to move with the arms, and slide across the screens on the supporting surface.

6. The screen printing machine as described in claim 1, wherein the spraying mechanism comprises, a rotating device with an output shaft capable of rotating around its axis, a mounting plate connected to the output shaft, a plurality of containers fixed to the mounting plate for containing the printing material and each comprising an outlet that can be opened to allow the printing material to flow out, and when the roller is moved to abut against an outlet of one container, the container is capable of being urged to dispense the printing material onto the roller.

7. The screen printing machine as described in claim 6, wherein the mounting plate and the container are retained within the receiving space.

8. The screen printing machine as described in claim 7, wherein the rotating device is a motor.

9. The screen printing machine as described in claim 7, further comprising an exposure device located at an opposite side of the support member.

10. The screen printing machine as described in claim 7, further comprising a controller connected to the rotating device and the sliding device for controlling operations thereof.

* * * * *